United States Patent [19]

Cherry et al.

[11] Patent Number: 4,478,347

[45] Date of Patent: Oct. 23, 1984

[54] UNITARY END CLOSURE AND SEAL SHIELD MEMBER FOR VACUUM INTERRUPTER

[75] Inventors: Sidney J. Cherry, Elmira; Richard A. White, Horseheads, both of N.Y.

[73] Assignee: Westinghouse Electric Corp., Pittsburgh, Pa.

[21] Appl. No.: 228,040

[22] Filed: Jan. 23, 1981

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 2,323,702 | 7/1943 | Berkey | 200/144 B |
| 3,280,286 | 10/1966 | Ranheim | 200/144 B |
| 3,430,015 | 2/1969 | Crouch et al. | 200/144 B |
| 3,440,376 | 4/1969 | Rabinowitz | 200/144 B |
| 3,541,284 | 11/1970 | Wachta | 200/144 B |
| 3,656,225 | 4/1972 | Bereza | 29/472.7 |
| 3,657,502 | 4/1972 | Cherry et al. | 200/144 B |
| 3,920,942 | 11/1975 | Yanaglsawa | 200/144 B |
| 4,229,631 | 10/1980 | Arakawa et al. | 200/144 B |
| 4,394,554 | 7/1983 | Warabi et al. | 200/144 B |

FOREIGN PATENT DOCUMENTS

| | | |
|---|---|---|
| 536204 | 10/1931 | Fed. Rep. of Germany . |
| 571959 | 1/1958 | Italy . |
| 1182782 | 3/1970 | United Kingdom . |

*Primary Examiner*—J. R. Scott

*Attorney, Agent, or Firm*—W. G. Sutcliff

[57] ABSTRACT

An improved vacuum interrupter structure with a unitary end closure and end seal shield member which is sealed to the end of the generally cylindrical body of the interrupter. This member performs the function of sealing the generally cylindrical body at the opposed ends, and also to shield the seal area from hot material which may evolve from the contacts during contact opening. The resultant end shield structure provides an improved breakdown voltage characteristic for the interrupter.

4 Claims, 4 Drawing Figures

UNITARY END CLOSURE AND SEAL SHIELD MEMBER FOR VACUUM INTERRUPTER

BACKGROUND OF THE INVENTION

The present invention relates to vacuum circuit interrupters, and more particularly to an improved end closure and end seal shield member which is a unitary member. This unitary member implies fabrication by minimizing the number of vacuum seals which need to be made.

The vacuum circuit interrupter has gained wide acceptance as a reliable switching means in electrical transmission and distribution systems over a wide range of operating voltages and currents. A generalized description of vacuum circuit interrupters and a method of fabrication are set out in U.S. Pat. No. 3,656,225. The interrupter structure discussed in this above prior art employs a generally cylindrical ceramic envelope body with metallized end seal surfaces. Each end of the ceramic body has sealed thereto an end closure plate, which is part of a manufacturing subassembly which includes a conductive support rod sealed through the end plate, and a cylindrical end shield member extending from the end plate. An end seal member is sealed to and extends from the perimeter of the end plate to permit final sealing of the evacuated device. Thus, a multiplicity of seals and parts are associated with the envelope end closure. It is desirable to minimize the number and area of vacuum seals to insure reliable long-lived circuit interrupter operation. During circuit interruption, arcing between the separated contacts evolves significant hot materials which can damage the vacuum seals. The interrupter device operating mechanism imparts significant forces to the end closures during contact opening and closing which also stresses the vacuum seal areas.

The use of end shields have been shown to improve the breakdown voltage characteristic for the interrupter. The end shield alters the electric field and electron emission proximate the insulator and metal end seal interface. This insures that voltage breakdown will in general occur across the primary arcing contacts rather than along the insulator body of the interrupter.

The present invention also finds use in a vacuum electrical fuse switching device. The end structure performs the function of being a simplified end seal member while performing a shielding function.

SUMMARY OF THE INVENTION

It is the object of the present invention to provide a simplified reliable vacuum interrupter structure which minimizes the parts and seal brazing operations, and the number of seal areas in fabricating the device. An improved unitary end closure, end seal shield member is sealed to the metallized end surfaces of a ceramic body portion. This unitary end closure and end seal shield member is brazed to the contact assembly, and thereafter sealed to the main insulating body portion of the interrupter during evacuation as the final fabrication step.

DESCRIPTION OF THE PREFERRED EMBODIMENTS

Figure 1:
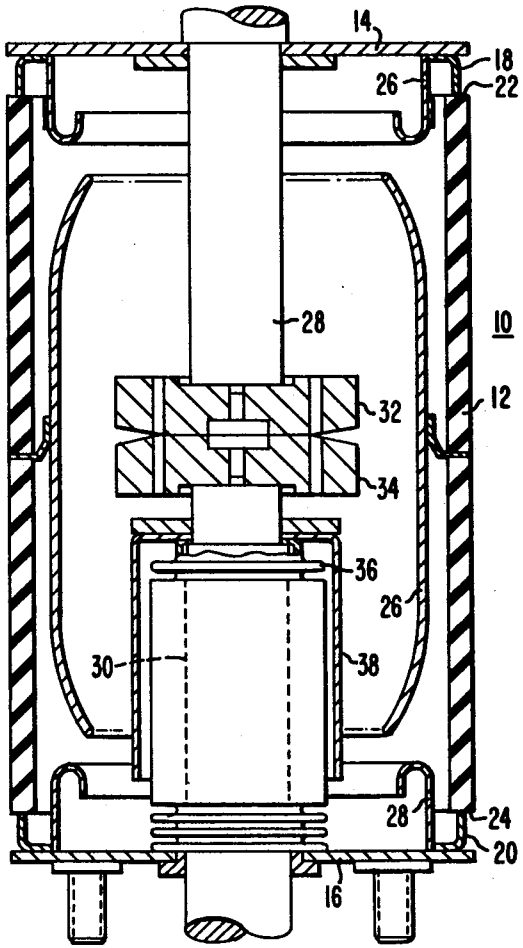
FIG. 1 PRIOR ART
FIG. 1 is a side elevation view, partly in section, of a prior art vacuum interrupter structure.

A conventional, prior art vacuum interrupter 10 is seen in FIG. 1. The vacuum interrupter 10 comprises a generally cylindrical insulating body portion 12, and opposed end plates 14 and 16 at respective ends of the cylindrical body portion 12. Annular end seal means 18 and 20 are used to seal respective end plates 14 and 16 to metallized end surfaces 22 and 24 on the cylindrical body portion 12. Generally, cylindrical end shields 26 and 28 extend from the respective end plates 14 and 16 closely spaced from the opposed ends of body portion 12 and end seal means 18 and 20 to protect the vacuum seal areas from vaporized contact material which evolves during arcing between contacts during circuit interruption.

The vacuum interrupter 10 includes the other conventional components, a center arcing shield 26, conductive contact support rods 28 and 30, contact members 32 and 34, bellows 36 associated with the movable contact 34, and bellows shield 38.

It is essential that a good vacuum of about $10^{-4}$ Torr or better be maintained within the vacuum interrupter to insure its reliable operation. The vacuum seal areas associated with the end seal means are the final seals made during manufacture, with the entire device disposed within an evacuated furnace for final pumpdown and sealing as described in U.S. Pat. No. 3,656,225.

The conventional device structure seen in FIG. 1 has a plural part end structure with two separate vacuum seals at each end of the device.

Figure 2:
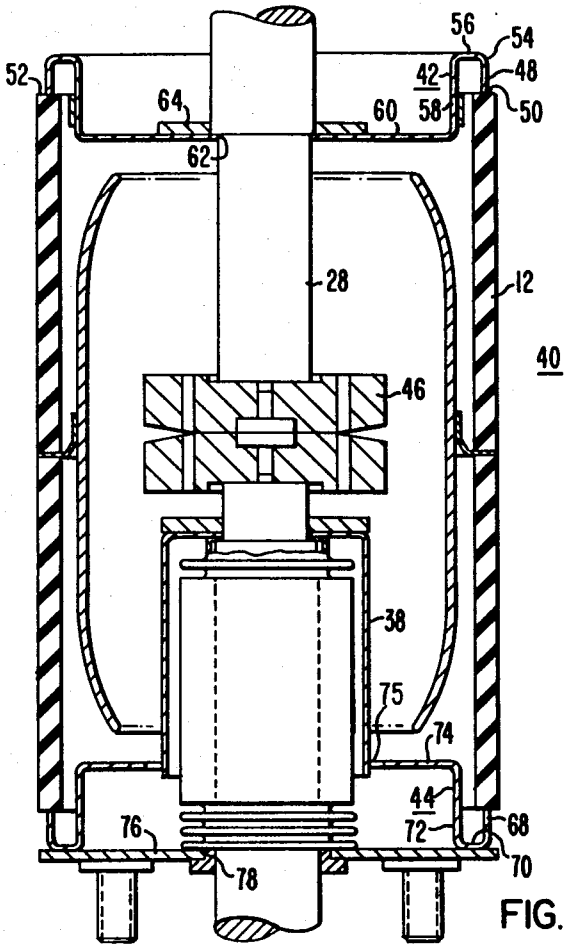
FIG. 2 is a side elevation view, partly in section, of a vacuum interrupter structure of the present invention.
Figure 3:
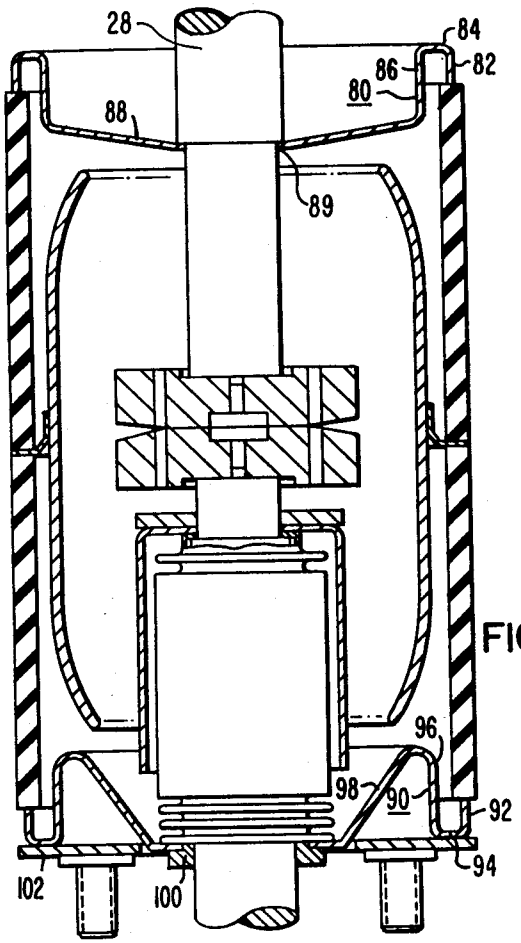
FIG. 3 is a side elevation view, partly in section, of another embodiment vacuum interrupter of the present invention.

The vacuum interrupter embodiments of the present invention are seen in FIGS. 2 and 3 and include a simplified, unitary end closure and seal member structure. This simplified structure at the fixed contact end of the interrupter only requires a single annular vacuum seal during manufacture. The end closure and seal member extends from and is sealed to the end of the cylindrical body portion, and extends radially inward to the conductive support rod.

In the embodiment of the invention seen in FIG. 2, the vacuum interrupter 40 has the basic structure seen in FIG. 1, except with respect to the end closure and seal member structures 42 and 44 at opposed ends of the interrupter 40. The end closure and seal member 42 at the fixed contact end 46 of the interrupter 40 is a unitary member. This unitary end closure and seal member 42 includes a first cylindrical portion 48 of a diameter equal to the diameter of the insulating body portion 12. A first end 50 of this first cylindrical portion 48 is a free end which is sealable to the metallized end surface 52 of the body portion 12. This metallized end surface 52 is prepared by conventional moly-manganese process to facilitate sealing to the end seal member 42. The other end 54 of this first cylindrical portion 48 is continued in a radially inwardly directed first transverse portion 56. The inwardly extending end of first transverse portion 56 is continued in a second cylindrical portion 58 which is of a diameter less than the body portion 12. The second cylindrical portion 58 extends with the body portion 12 to protect the seal formed at the metallized surface 52. The second cylindrical 58 is continued in a circular inwardly extending base portion 60 which fits within the body portion 12.

This circular base portion 60 serves as an end plate or end closure with conductive support rod 28 sealed through a central aperture 62 in base portion 60. An annular support ring 64 is provided about the conductive support rod 28 outside the interrupter and is brazed to the exterior surface of the base portion 60 to strengthen the end plate or closure.

At the movable end of the interrupter embodiment of FIG. 2, the end closure and seal member 44 includes a first cylindrical portion 68, a radially inwardly directed first transverse portion 70, a second cylindrical portion 72 of a diameter less than the body portion 12, and a circular inwardly extending base portion 74. This base portion 74 has a central aperture 75 therethrough which permits the bellows shield 38 to pass therethrough. An annular end plate 76 is sealed near its perimeter to the exterior surface of the first transverse portion 70. The inner rim 78 of the annular end plate 76 is sealed to one end of the bellows 38 which permits axial movement of the movable contact.

In the embodiment seen in FIG. 3, the interrupter has a further modified end closure and seal means for both the fixed contact end and for the movable contact end. The end closure and seal means 80 at the fixed contact end has a first cylindrical portion 82, radially inwardly directed transverse portion 84, and a second cylindrical portion 86. The second cylindrical portion 86 is continued in an axially inwardly dished closure portion 88 with a central aperture 89 for sealably receiving the conductive support rod 28.

The movable contact end of the interrupter includes end closure and seal member 90 which has a first cylindrical portion 92, a radially inwardly directed transverse portion 94, a second cylindrical portion 96 which fits within the body portion 12. A generally conic closure portion 98 is continued from the end of the second cylindrical portion 90 extending within the body portion 12. The conic closure portion 92 extends back outwardly from the volume defined by the body portion, and is truncated with a central aperture 100 for receiving the bellows to which the conic closure portion 98 is sealed. An annular end plate 102, which is disposed transverse to the body portion longitudinal axis is sealed to the exterior surface of the transverse portion 94.

In the FIG. 3 embodiment, the dished end closure portion 88 at the fixed end, and conic closure portion 98 at the movable end strengthen these end closures which are subjected to significant forces when the interrupter actuating mechanism applies axial opening and closing force to the support rods for the interrupter contacts.

Figure 4:
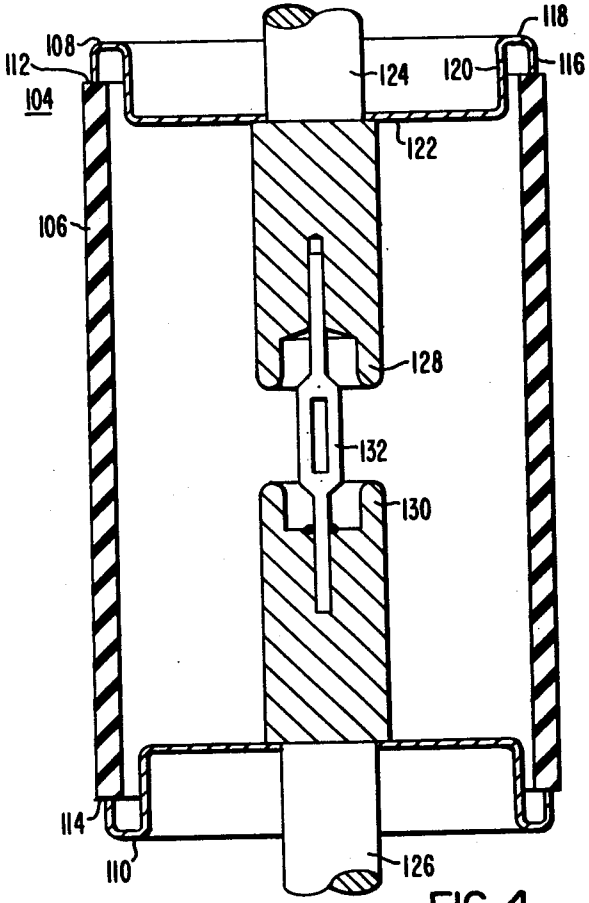
FIG. 4 illustrates a fused electrical device.

Another embodiment of the present invention is seen in FIG. 4, wherein a fused electrical switching device 104 comprises an insulating generally cylindrical envelope 106 with end members 108, 110 hermetically sealed to opposed end surfaces 112, 114 of the envelope 106. The end members 108, 110 each comprise a first cylindrical portion 116 of the same diameter as envelope 106 and is sealed to the metallized end surface 112. The other end of the first cylindrical portion 116 is continued in a radially inwardly directed transverse portion 118 which is continued in a second cylindrical portion 120 which is of a diameter less than the envelope 106 diameter. The second cylindrical portion extends coaxially within the first cylindrical portion 116 and the envelope 106. A radially inwardly extending base portion 122 is continued from the end of second cylindrical portion 120 within the envelope 106 and is sealed to the electrical lead-in 124, 126. Within the highly evacuated device 104 the electrical lead-ins terminate in aligned but spaced-apart electrical contacts 128, 130, with a fuse member 132 bridged between contacts 128, 130. Fuse member 132 is a conductive member of a material and dimension to carry the normal device operating current. The fuse member 132 is designed to be destructively heated by a predetermined overcurrent. An arc will form between contacts 128, 130 when the fuse member 132 is destroyed. The second cylindrical portion 120 of the end members serves to shield the ends of the insulating envelope 106 and the seal area at the envelope and end member interface from the remnants of the fuse member. This shielding insures that the arc extinguishes without a voltage breakdown along the envelope and prevents hot, vaporized particles from the fuse damaging the hermetic seal.

What we claim is:

1. An improved vacuum circuit interrupter in which a cylindrical envelope is hermetically sealed by end members to maintain a vacuum within the sealed envelope, with a fixed support rod sealed through one end member and supporting a fixed contact within the envelope, and a movable support rod sealed to one end of a bellows seal member the other end of the bellows seal member sealed to the end member with the support rod passing through the opposed end member and supporting a movable contact within the envelope, with a central cylindrical arcing shield disposed within the envelope about the contacts, and arcing end shields extending from the respective end members, the improvement wherein the end member at the fixed support rod end comprises a first unitary end closure and arcing end shield comprising a first cylindrical portion of a diameter equal to the envelope diameter, one end of the first cylindrical portion sealed to one end surface of the cylindrical envelope, with the other end of the first cylindrical portion being continued in a radially inwardly directed transverse portion continued in a second cylindrical portion of a diameter less than the cylindrical envelope and greater than the diameter of the central cylindrical arcing shield, the second cylindrical portion includes a radially inwardly extending base portion fitted within the cylindrical envelope, the base portion is sealed to the fixed support rod.

2. The improved vacuum circuit interrupter set forth in claim 1, wherein the radially inwardly extending base portion is dished inward to strengthen said base portion.

3. The improved vacuum circuit interrupter set forth in claim 1, wherein the other end member at the movable support rod end comprises a second unitary end closure and arcing end shield comprising a first cylindrical portion of a diameter equal to the envelope diameter and sealed to the other end surface of the cylindrical envelope, with the other end of the first cylindrical portion being continued in a radially inwardly directed transverse portion continued in a second cylindrical portion of a diameter less than the cylindrical envelope and greater than the diameter of the central cylindrical arcing shield, the second cylindrical portion includes a radially inwardly directed portion fitted within the cylindrical envelope, and an annular end plate is supported from the radially inwardly directed transverse portion of the end member, with the inner rim of the annular end plate sealed to the extending end of the bellows seal means.

4. The improved vacuum circuit interrupter set forth in claim 1, wherein the other end member at the movable support rod end comprises a second unitary end closure and arcing end shield comprising a first cylindrical portion of a diameter equal to the envelope diameter and sealed to the other end surface of the cylindrical envelope, with the other end of the first cylindrical portion being continued in a radially inwardly directed transverse portion continued in a second cylindrical portion of a diameter less than the cylindrical envelope and greater than the diameter of the central cylindrical arcing shield, the second cylindrical portion is continued as a generally inwardly directed truncated conic portion, the end of the truncated conic portion is sealed to the extending end of the bellows seal means.

* * * * *